US011248188B2

(12) United States Patent
Egersdoerfer et al.

(10) Patent No.: US 11,248,188 B2
(45) Date of Patent: Feb. 15, 2022

(54) LUBRICANT COMPOSITION

(71) Applicant: Klueber Lubrication Muenchen SE & CO. KG, Munich (DE)

(72) Inventors: Karl Egersdoerfer, Munich (DE); Thomas Kilthau, Geretsried (DE); Daniel Chall, Stadtbergen (DE); Stefan Seemeyer, Wolfratshausen (DE)

(73) Assignee: KLUEBER LUBRICATION MUENCHEN SE & CO. KG, Munich (DE)

( * ) Notice: Subject to any disclaimer, the term of this patent is extended or adjusted under 35 U.S.C. 154(b) by 0 days.

(21) Appl. No.: 17/059,519

(22) PCT Filed: Aug. 9, 2019

(86) PCT No.: PCT/EP2019/071417
§ 371 (c)(1),
(2) Date: Nov. 30, 2020

(87) PCT Pub. No.: WO2020/038737
PCT Pub. Date: Feb. 27, 2020

(65) Prior Publication Data

US 2021/0207053 A1 Jul. 8, 2021

(30) Foreign Application Priority Data

Aug. 23, 2018 (DE) ..... 10 2018 006 661.5

(51) Int. Cl.

| | |
|---|---|
| ***C10M 169/04*** | (2006.01) |
| ***C10M 105/36*** | (2006.01) |
| ***C10M 105/38*** | (2006.01) |
| ***C10M 107/34*** | (2006.01) |

(Continued)

(52) U.S. Cl.
CPC ..... *C10M 169/04* (2013.01); *C10M 105/36* (2013.01); *C10M 105/38* (2013.01);
(Continued)

(58) Field of Classification Search
CPC ..... C10M 129/14; C10M 129/76; C10M 169/04; C10M 2203/1006;
(Continued)

(56) References Cited

U.S. PATENT DOCUMENTS 3,478,107 A 11/1969 Vineyard
4,657,686 A 4/1987 Holstedt
(Continued)

FOREIGN PATENT DOCUMENTS

DE 102009022593 A1 12/2009
DE 112010000922 T5 9/2012
(Continued)

OTHER PUBLICATIONS

Panayotis S. Rodis et al., "Partitioning of olive oil antioxidants between oil and water phases", in: Journal of Agricultural and Food Chemistry, Jan. 2002, p. 596-601, American Chemical Society Washington, D. C. USA.

(Continued)

*Primary Examiner* — Vishal V Vasisth
(74) *Attorney, Agent, or Firm* — Leydig, Voit & Mayer, Ltd.

(57) ABSTRACT

A lubricant composition is provided which comprises a base oil and hydroxytyrosol and/or esters thereof. Also provided is a lubricant composition in which the esters have a solubility in the base oil at 25° C. of at least 0.1 g/l. Further provided is a lubricant composition in which the esters are at least partly carboxylic acid esters comprising esters of hydroxytyrosol and $C_{2-10}$ carboxylic acids.

19 Claims, 16 Drawing Sheets

(51) Int. Cl.

| | |
|---|---|
| ***C10M 129/14*** | (2006.01) |
| ***C10M 129/76*** | (2006.01) |
| *C10N 20/02* | (2006.01) |
| *C10N 30/10* | (2006.01) |
| *C10N 40/02* | (2006.01) |
| *C10N 40/04* | (2006.01) |

(52) U.S. Cl.
CPC ..... *C10M 107/34* (2013.01); *C10M 129/14* (2013.01); *C10M 129/76* (2013.01); *C10M 2207/023* (2013.01); *C10M 2207/289* (2013.01); *C10M 2207/2835* (2013.01); *C10M 2207/2855* (2013.01); *C10M 2209/1055* (2013.01); *C10N 2020/02* (2013.01); *C10N 2030/10* (2013.01); *C10N 2040/02* (2013.01); *C10N 2040/04* (2013.01)

(58) Field of Classification Search
CPC .. C10M 2203/1045; C10M 2203/1065; C10M 2205/0285; C10M 2207/023; C10M 2207/0406; C10M 2207/124; C10M 2207/2825; C10M 2207/2835; C10M 2207/2855; C10M 2207/289; C10M 2207/30; C10M 2207/401; C10M 2209/1033; C10M 2209/1055; C10M 2209/1085; C10M 107/34; C10M 105/36; C10M 105/38; C10N 2020/02; C10N 2030/10; C10N 2040/04; C10N 2040/06; C10N 2030/08; C10N 2040/02
See application file for complete search history.

(56) References Cited

U.S. PATENT DOCUMENTS

| | | | | |
|---|---|---|---|---|
| 4,689,162 | A | 8/1987 | Wirth | |
| 5,354,484 | A | 10/1994 | Schwind | |
| 2005/0154058 | A1* | 7/2005 | Gonzalez | A61K 31/222 514/546 |
| 2011/0124537 | A1 | 5/2011 | Kilthau | |
| 2011/0306429 | A1 | 12/2011 | Mikami | |
| 2014/0377435 | A1 | 12/2014 | Müller | |
| 2017/0295812 | A1* | 10/2017 | Hansen | A23D 7/04 |
| 2017/0327760 | A1 | 11/2017 | Egersdorfer | |

FOREIGN PATENT DOCUMENTS

| | | | |
|---|---|---|---|
| DE | 102014018718 | A1 | 6/2016 |
| EP | 0447916 | A1 | 9/1991 |
| EP | 0620267 | A1 | 4/1993 |
| EP | 0673991 | A1 | 9/1995 |
| EP | 0678569 | A3 | 4/1996 |
| EP | 1541544 | A1 | 6/2005 |
| EP | 2359702 | B1 | 6/2014 |
| GB | 1271556 | A | 4/1972 |
| JP | S 5915477 | A | 1/1984 |
| JP | H 07126681 | A | 5/1995 |
| WO | WO 9732947 | A1 | 9/1997 |
| WO | 2007051329 | A1 | 5/2007 |
| WO | WO 2009013596 | A2 | 1/2009 |
| WO | WO 2012042080 | A1 | 4/2012 |
| WO | WO 2016053971 | A1 | 4/2016 |

OTHER PUBLICATIONS

Kellie L. Tuck et al., "Major Phenolic Compounds In Olive Oil: Metabolism and Health Effects", in: The Journal Of Nutritional Biochemistry, p. 636-644. Jul. 2002, Elsevier, USA.

Chimi, N. et al., "contribution a l'etude comparative des pouvoirs antioxydants dans l'huile d'olive du tyrosol de l'hydroxytyrosol, de l'acide cafeique de l'oleuropeine et du b.h.t.," Sep. 1988, pp. 339-344, Laboratorie de Fenie des Procedes, France.

* cited by examiner

LUBRICANT COMPOSITION

CROSS-REFERENCE TO PRIOR APPLICATIONS

This application is a U.S. National Phase application under 35 U.S.C. § 371 of International Application No. PCT/EP2019/071417, filed on Aug. 9, 2019, and claims benefit to German Patent Application No. DE 10 2018 006 661.5, filed on Aug. 23, 2018. The International Application was published in German on Feb. 27, 2020 as WO 2020/038737 A1 under PCT Article 21(2).

FIELD

The present invention relates to a lubricant composition containing an antioxidant that inhibits oxidative degradation of the composition. The invention further relates to a method for producing the lubricant composition and to its use.

BACKGROUND

Manufacturers of lubricants are under constant pressure to improve their products according to manufacturer and user requirements. In particular, chemical and thermal stability of the lubricants and, associated therewith, their resistance to oxidation processes is to be constantly improved. High resistance to oxidation processes is of particular importance as they impair the physical and chemical properties of the lubricant and reduce its ability to protect the surfaces treated with it. For example, oxidation processes may increase the acidity of the lubricant, thereby accelerating wear and corrosion of metal surfaces. Oxidation processes can also lead to the formation of oxidation products which impair the lubricity. Furthermore, oxidation processes can increase the viscosity of the oil and thereby undesirably influence the distribution of the lubricant on the surfaces.

Moreover, when it comes to lubricating metallic surfaces, deposition of metal-containing particles in the lubricant can occur. These particles can act as oxidation catalysts and accelerate the degradation of the lubricant. This is true in particular for high temperatures, as are customary, for example, in engines.

In order to prevent these undesired effects, an oil-soluble antioxidant is frequently added to lubricants. In practice, amines such as bis(4-(1,1,3,3-tetramethylbutyl)phenyl) amine, styrenated phenylamine, sterically hindered phenols, such as thiodiethylene bis(2-(2-di-tert-butyl-4-hydroxyphenyl)propionate and/or combinations of two or three of the stated substance groups are often used as antioxidants.

There are numerous patents describing antioxidant additives. For example, GB-A-1 271 556 discloses an antioxidant additive which is a mixture of (a) the reaction product of a boron compound with a long-chain hydrocarbon carboxylic acid or an anhydride thereof with a primary or secondary amine and (b) a polycyclic phenolic compound. U.S. Pat. No. 5,354,484 describes a lubricant additive providing high-temperature stability and containing a mixture of (i) an amine salt of a substituted phosphoric acid and (ii) an amine-substituted hydrocarbon succinic acid compound.

In addition, several prior art documents indicate the use of a combination of a boron compound and an aromatic amine in lubricant compositions. Examples of such documents include EP-A-0 678 569, EP-A-0 673 991, U.S. Pat. Nos. 4,657,686, 4,689,162, EP-A-0 620 267, EP-A-0 447 916 and JP-A-07 12 66 81.

U.S. Pat. No. 3,478,107 discloses that branched alkyl formaldehyde mercaptals of the formula R'—S—CH2-SR", where R' and R" are independently branched C3-C4-alkyl radicals can be used as antiwear additives in lubricating oils.

The abovementioned additives generally exhibit satisfactory antioxidant properties. However, the amount to be used is usually quite high, which is disadvantageous for cost reasons. In addition, at higher concentrations there is the risk of the properties of the lubricant being undesirably changed. In addition, the aforementioned additives generally have to be synthesized in complex processes.

DE112010000922 T5 further discloses a lubricant composition comprising a base lubricant consisting of a base oil and a thickener and an additive added to the base lubricant, the additive comprising at least one compound selected from plant-derived polyphenol compounds and compounds formed by decomposition thereof. Preferred polyphenol compounds are gallic acid, ellagic acid, chlorogenic acid, caffeic acid, curcumin and quercetin. Unlike the synthetic antioxidants described above, polyphenol compounds are natural substances. However, the compounds mentioned exhibit a rather low antioxidant effect. In addition, they are in part highly colored (for example curcumin), which limits their possible uses.

SUMMARY

In an embodiment, the present invention provides a lubricant composition comprising: a base oil and hydroxytyrosol and/or esters thereof.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
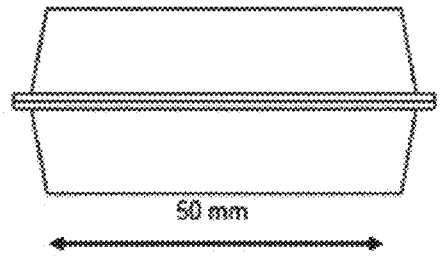
FIG. 1: Capped evaporating dishes in side view.

In an embodiment, a lubricant composition is provided which comprises an antioxidant by means of which the abovementioned disadvantages can be at least partly eliminated.

In an embodiment, a lubricant composition is provided comprising a base oil and hydroxytyrosol and/or esters thereof.

Hydroxytyrosol belongs to the family of natural polyphenols and has the following structural formula:

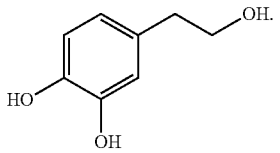

It is known that hydroxytyrosol has antioxidant properties. However, it was surprising for the person skilled in the art that it has equivalent or even better antioxidant properties relative to the use concentration than synthetic antioxidants customarily used in practice, and that its addition to common base oils is possible without impairing their functional properties.

Esters of hydroxytyrosol can also be used according to the invention. Particular preference is given to esters which have a solubility in the respective base oil at 25° C. of at least 0.1 g/l, for example of 0.1 to 5 g/l. The hydroxytyrosol in the lubricant composition may also be present only partly as an ester. Particularly suitable esters according to the invention are carboxylic acid esters, as discussed in more detail below. In the following, where appropriate, references to hydroxytyrosol shall also include its esters.

It is in principle possible to use hydroxytyrosol in pure form. In order to increase the solubility of hydroxytyrosol, it is preferred in one embodiment of the invention for the lubricant composition to contain solubilized hydroxytyrosol. The term "solubilized hydroxytyrosol" is to be understood as meaning hydroxytyrosol whose solubility with respect to the base oil used in each case has been increased by adding a solubilizing agent. The type and amount of solubilizing agent depends, inter alia, on the base oil used in each case, the desired dissolution properties of the hydroxytyrosol and the notified uses of the lubricant compositions. The term solubilizing agent shall also include, in particular, compounds which form a chemical compound with the hydroxytyrosol, for example by forming esters.

Suitable solubilizing agents for polyphenols are known and are described, for example, in the publications EP 2 359 702 B1, WO 2007/051329 A1, US 2014/0377435 A1, the disclosure of which is incorporated by reference. It was found in practical experiments that particularly suitable solubilizing agents according to the invention are $C_{2-10}$ carboxylic acids, which may be present in branched and/or unbranched form, may have one or more substituents, in particular hydroxyl groups and/or one or more carboxylic acid groups. Hydroxycarboxylic acids having at least 2, preferably 3 carboxylic acid groups are preferred. Hydroxycarboxylic acids having at least 2, preferably 3 hydroxyl groups and/or hydroxycarboxylic acids having at least 2, preferably 3 hydroxyl groups and at least 2, preferably 3 carboxylic acid groups are likewise preferred. Particularly suitable carboxylic acids according to the invention are selected from the group consisting of citric acid, malic, fumaric, gluconic, glycolic, lactic, oxalic, tartaric, mandelic salicylic acid and/or mixtures thereof. Citric acid is particularly preferred.

Without committing to a mechanism according to the invention, it is assumed that the hydroxytyrosol forms esters with the carboxylic acids, whereby the solubility of the hydroxytyrosol is increased.

Thus, in a preferred embodiment of the invention, the lubricant composition comprises at least partly hydroxytyrosol carboxylic acid esters, in particular esters of hydroxytyrosol and $C_{2-10}$ carboxylic acids, wherein the $C_{2-10}$ carboxylic acids may be present in branched and/or unbranched form, may have one or more substituents, in particular hydroxyl groups and/or one or more carboxylic acid groups. The lubricant composition particularly preferably comprises at least partly esters of hydroxytyrosol and hydroxycarboxylic acids having at least 2, preferably 3 carboxylic acid groups. The lubricant composition likewise preferably comprises at least partly esters of hydroxytyrosol and hydroxycarboxylic acids having at least 2, preferably 3 hydroxyl groups and/or esters of hydroxytyrosol and hydroxycarboxylic acids having at least 2, preferably 3 hydroxyl groups and at least 2, preferably 3 carboxylic acid groups. According to the invention, the lubricant composition particularly preferably also comprises at least partly esters of hydroxytyrosol and carboxylic acids selected from the group consisting of citric acid, malic, fumaric, gluconic, glycolic, lactic, oxalic, tartaric, mandelic salicylic acid and/or mixtures thereof. Most preferably, the lubricant composition comprises at least partly esters of hydroxytyrosol and citric acid.

Advantageously, the lubricant composition contains hydroxytyrosol and/or its ester in an oxidation-inhibiting amount. In a preferred embodiment of the invention, the proportion of hydroxytyrosol and/or of its esters is from 0.01% by weight to 2% by weight and/or from 0.1% by weight to 2% by weight and/or from 0.1% by weight to 1.5% by weight, and/or from 0.01% by weight to 0.5% by weight, and/or from 0.05% by weight to 1% by weight, even more preferably from 0.1% by weight to 1% by weight, even more preferably from 0.1% by weight to 0.5% by weight and in particular from 0.25% by weight to 0.35% by weight, in each case based on the total weight of the lubricant composition.

More preferably, the amount of solubilizing agent in the lubricant composition, based on the total amount of hydroxytyrosol and solubilizing agent, is advantageously 0.5 to 4% by weight, more preferably from 0.5 to 3.5% by weight, more preferably from 0.5 to 3% by weight, more preferably from 1 to 3% by weight, more preferably from 1.5 to 3% by weight and in particular from 1.5 to 3% by weight.

The term "base oil" is to be understood as meaning the customary base liquids used for the production of lubricants, in particular oils which can be assigned to the groups I, II, III, IV or V in accordance with the classification of the American Petroleum Institute (API). Particularly preferred base oils are selected from the group consisting of esters, in particular synthetic esters, polyglycols, naphthenic and/or aromatic mineral oils, synthetic hydrocarbons, phenyl ethers, polyalphaolefins, native base oils and derivatives of native oils and/or mixtures thereof. Particularly preferred according to the invention are esters, in particular synthetic esters, and/or mixtures of esters, in particular synthetic esters, native base oils and polyglycols with synthetic hydrocarbons and/or polyalphaolefins.

In a preferred embodiment of the invention, the base oil is selected from the group consisting of an ester of an aromatic and/or aliphatic dicarboxylic, tricarboxylic or tetracarboxylic acid having one or a mixture of $C_7$ to $C_{22}$ alcohols, of a polyphenyl ether or alkylated diphenyl ether, of an ester of trimethylolpropane, pentaerythritol or dipentaerythritol with aliphatic $C_7$ to $C_{22}$ carboxylic acids, of $C_{18}$ dimer acid esters, manufactured from $C_7$ to $C_{22}$ alcohols, of complex esters, as individual components or in any mixture.

Particularly preferred base oils are esters, in particular synthetic esters, and mixtures thereof with synthetic hydrocarbons and/or polyalphaolefins. Thus, it was found in practical experiments that these base oils display a particularly good absorption capacity for hydroxytyrosol, in particular for hydroxytyrosol which was solubilized with citric acid.

Also preferred base oils are triglyceride-based native oils, preferably with a high oleic acid content, in particular selected from the group consisting of sunflower oil, rapeseed oil, castor oil, linseed oil, corn oil, safflower oil, soybean oil, flaxseed oil, groundnut oil, lesquerella oil, palm oil and derivatives thereof.

Also preferred base oils are triglycerides having a content (based on the bound fatty acids) of at least 50% by weight oleic acid and less than 10% by weight polyunsaturated fatty acids and derivatives thereof.

The base oils may be used individually or in combination (if miscible). Particularly preferred base oils have a viscosity in the range of 10 $mm^2/s$ to 1000 $mm^2/s$, measured at 40° C.

In one embodiment of the invention, the proportion of the base oil in the lubricant composition according to the invention is from 99.99% by weight to 90% by weight, more preferably from 99.5% by weight to 94.5% by weight and in particular from 99.75% by weight to 94.75% by weight based in each case on the total weight of the lubricant composition. Here, the abovementioned values relate in particular to lubricant compositions which are present as lubricating oil, i.e. substantially without thickeners. In contrast, if the lubricant composition is present as lubricating grease, i.e. with thickener, the proportion of the base oil in the lubricant composition according to the invention is preferably from 70% by weight to 97.00% by weight.

Hydroxytyrosol and/or its esters can be present as sole antioxidant or in combination with further antioxidants. Particularly suitable further antioxidants according to the invention are the following compounds: styrenated diphenylamines, diaromatic amines, phenolic resins, thiophenol resins, phosphites, butylated hydroxytoluene, butylated hydroxyanisole, phenyl-alpha-naphthylamine, phenyl-beta-naphthylamine, octylated/butylated diphenylamine, di-alpha tocopherol, di-tert-butyl-phenyl, benzenepropanoic acid, sulfur-containing phenolic compounds and mixtures of these components.

The lubricant composition may further comprise anticorrosion additives, metal deactivators, antiwear additives and/or ion complexing agents. These include triazoles, imidazolines, N-methylglycine (sarcosine), benzotriazole derivatives, N,N-bis(2-ethylhexyl)-ar-methyl-1H-benzotriazole-1-methanamine; n-methyl-N(1-oxo-9-octadecenyl) glycine, mixtures of phosphoric acid and mono- and diisooctyl esters reacted with ($C_{11-14}$)-alkylamines, mixtures of phosphoric acid and mono- and diisooctyl esters reacted with tert-alkylamine and primary ($C_{12-14}$)-amines, dodecanoic acid, triphenyl phosphorothionate and amine phosphates. Commercially available additives are as follows: IRGAMET® 39, IRGACOR® DSS G, Amin O; SARKOSYL®0 (Ciba), COBRATEC® 122, CUVAN® 303, VANLUBE®9123, CI-426, CI-426EP, CI-429 and CI-498.

Other conceivable antiwear additives include amines, amine phosphates, phosphates, thiophosphates, phosphorothionates and mixtures of these components. Commercially available antiwear additives include IRGALUBE® TPPT, IRGALUBE® 232, IRGALUBE® 349, IRGALUBE®21 1 and ADDITIN® RC3760 Liq 3960, FIRC-SHUN® FG 1505 and FG 1506, NA-LUBE® KR-015FG, LUBEBOND®, FLUORO® FG, SYNALOX® 40-D, ACHESON® FGA 1820 and ACHESON® FGA 1810.

Moreover, the lubricant composition may include solid lubricants such as PTFE, BN, pyrophosphate, Zn oxide, Mg oxide, pyrophosphates, thiosulfates, Mg carbonate, Ca carbonate, Ca stearate, Zn sulfide, Mo sulfide, W sulfide, Sn sulfide, graphite, graphene, nanotubes, $SiO_2$ modifications or a mixture thereof.

The lubricant composition may also contain thickeners, especially metal soaps, metal complex soaps, bentonites, ureas, silicates, sulfonates and/or polyimides. The proportion of thickener in the lubricant composition according to the invention is preferably from 1% by weight to 20% by weight, in each case based on the total weight of the lubricant composition.

The invention further relates to a method for producing a lubricant composition, preferably a lubricant composition according to one or more of the embodiments of the invention, comprising the following steps:

Providing a base oil

Mixing the base oil with hydroxytyrosol and/or its esters, thereby obtaining the lubricant composition.

Particularly suitable embodiments for base oils, esters of the hydroxytyrosol, as well as solubilizing agents and/or additives are those discussed in the context of the present invention in relation to the lubricant composition according to the invention.

In a particularly preferred embodiment of the invention, the mixing of the base oil with hydroxytyrosol and/or its esters takes place in the presence of a solubilizing agent, in particular in the presence of a solubilizing agent as discussed in the context of the present invention in relation to the lubricant composition according to the invention.

The method of the invention can also comprise further method steps in which, for example, the further components described in relation to the lubricant composition according to the invention, such as further antioxidants, thickeners, anticorrosion additives, metal deactivators, ion complexing agents and/or solid lubricants, are introduced.

The lubricant composition according to the invention is suitable for lubricating a wide variety of surfaces. In this respect, another subject matter of the present invention relates to the use of the lubricant composition for lubricating the surfaces of sliding partners in a tribological system. The lubricant combination is particularly preferably used as an intermediate for reducing friction and/or wear in a tribological system. In a further preferred embodiment, the lubricant composition is used simultaneously for force transmission, vibration damping and/or as an anticorrosive. Naturally, the lubricant composition is particularly useful in tribological and rheological systems which are exposed to great oxidative stress. A preferred embodiment of the invention therefore relates to the use of the lubricant composition for H1 high-temperature applications for lifetime and/or consumption lubrication in components such as, in particular, chains, transmissions, bearings or fittings and/or marine components.

The invention is explained in more detail below with reference to various examples.

Example 1: Preparation of Various Lubricant Compositions

Various lubricant compositions provided with antioxidants are prepared: The hydroxytyrosol used is a hydroxytyrosol solubilized with citric acid (about 2% by weight, based on the total amount of hydroxytyrosol and citric acid).

TABLE 1

| Composition | Base oil | Antioxidants |
|---|---|---|
| Comparative Example 01 | 99.87% isodecyl trimellitic ester | 0.13% bis(4-(1,1,3,3-tetramethylbutyl)phenyl)amine |
| Comparative example 02 | 99.87% isodecyl trimellitic ester | 0.13% styrenated diphenylamine |
| Inventive composition 01 | 99.87% isodecyl trimellitic ester | 0.13% hydroxytyrosol |
| Comparative Example 03 | 99.70% isodecyl trimellitic ester | 0.3% thiodiethylene bis(2-(2-di-tert-butyl-4-hydroxyphenyl)propionate |
| Comparative Example 04 | 99.87% isodecyl trimellitic ester | 0.13% pentaerythritol (3-(3,5-di-tert-butyl-4-hydroxyphenyl) |
| Comparative Example 05 | 100% octyldodecyl trimellitic ester | |
| Comparative Example 06 | 99.70% octyldodecyl trimellitic ester | 0.30% styrenated diphenylamine |
| Comparative Example 07 | 96.00% octyldodecyl trimellitic ester | 4.00% styrenated diphenylamine |
| Inventive composition 02 | 99.70% octyldodecyl trimellitic ester | 0.30% hydroxytyrosol |
| Comparative Example 08 | 99.73% polypropylene monoglycol ether | 0.27% bis(4-(1,1,3,3-tetramethylbutyl)phenyl)amine |
| Comparative Example 09 | 99.73% polypropylene monoglycol ether | 0.27% styrenated diphenylamine |
| Inventive composition 03 | 99.73% polypropylene monoglycol ether | 0.27% hydroxytyrosol |
| Comparative Example 10 | 99.80% pentaerythritol C5-C9 (hexane) ester | 0.2% bis(4-(1,1,3,3-tetramethylbutyl)phenyl)amine |
| Comparative Example 11 | 99.80% pentaerythritol C5-C9 (hexane) ester | 0.20% diphenylamine |
| Inventive composition 04 | 99.80% pentaerythritol C5-C9 (hexane) ester | 0.27% hydroxytyrosol |
| Inventive composition 05 | 99.99% isodecyl trimellitic ester | 0.01% hydroxytyrosol |
| Inventive composition 06 | 99.87% isodecyl trimellitic ester | 0.17% hydroxytyrosol |

TABLE 1-continued

| Composition | Base oil | Antioxidants |
|---|---|---|
| Inventive composition 07 | 99.70% isodecyl trimellitic ester | 0.30% hydroxytyrosol |
| Inventive composition 08 | 99.50% isodecyl trimellitic ester | 0.50% hydroxytyrosol |

Example 2: Measurement of the Evaporation Behavior and the Apparent Dynamic Viscosity of Selected Compositions from Example 1

Figure 2:
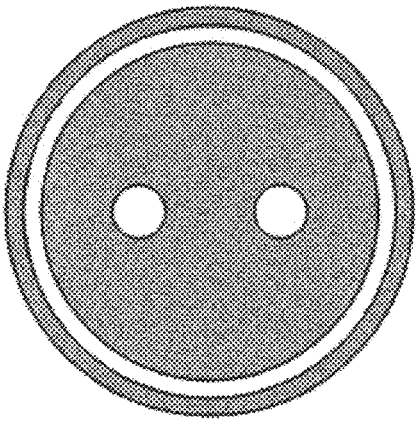
FIG. 2: Capped evaporating dishes in plan view.

2.1 The evaporation behavior and the apparent dynamic viscosity of inventive composition 1 and of comparative examples 1, 2, 3 and 4 are measured (capped dish tests, gas exchange takes place). For this purpose, the evaporation behavior and the change in the apparent dynamic viscosity [mPas] is determined multiple times as a criterion of progressive oxidation under thermal loading (72 h storage at 230° C. in each case, convection oven) as a comparative measurement. The sample amount per test is 5 g (+/−0.1 g). The evaporation behavior in % by weight is determined by backweighing. Also comparatively, by the rheological determination of the apparent dynamic viscosity (Anton Paar rheometer rotating, shear rate 300-1), conclusions are drawn about thermal aging (e.g. polymerization) or the protection against thermal aging. Capped evaporating dishes made of aluminum, diameter 50 mm, are used. The two opposite holes in the cap have a diameter of 5 mm and are 10 mm from the edge (see FIGS. 1 and 2). The use of a punching template is expedient here, but is not mandatory. The two dishes are bonded at the fold of the dishes by means of two staples.

Figure 3:
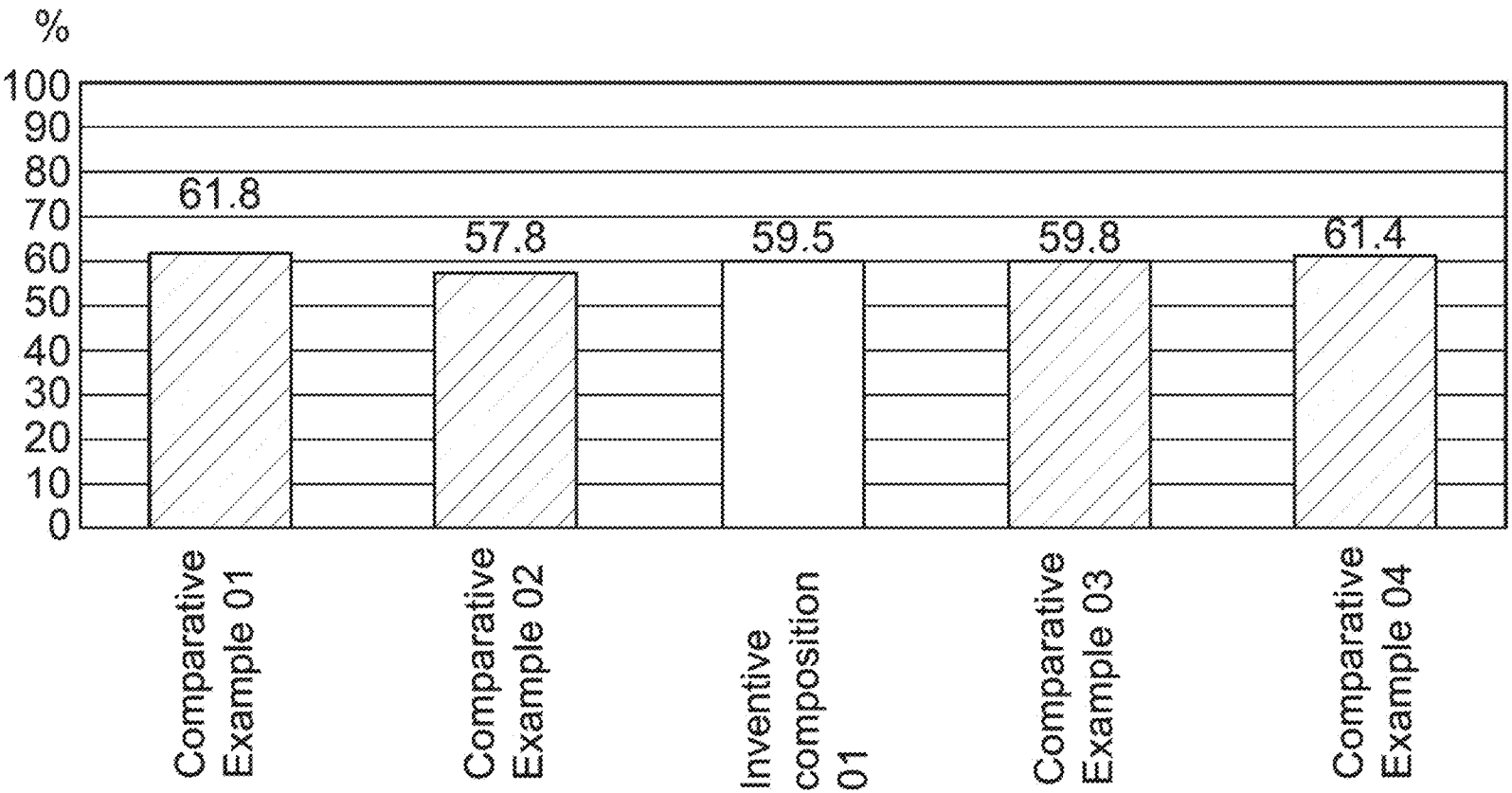
FIG. 3: Evaporation behavior of various lubricant compositions.
Figure 4:
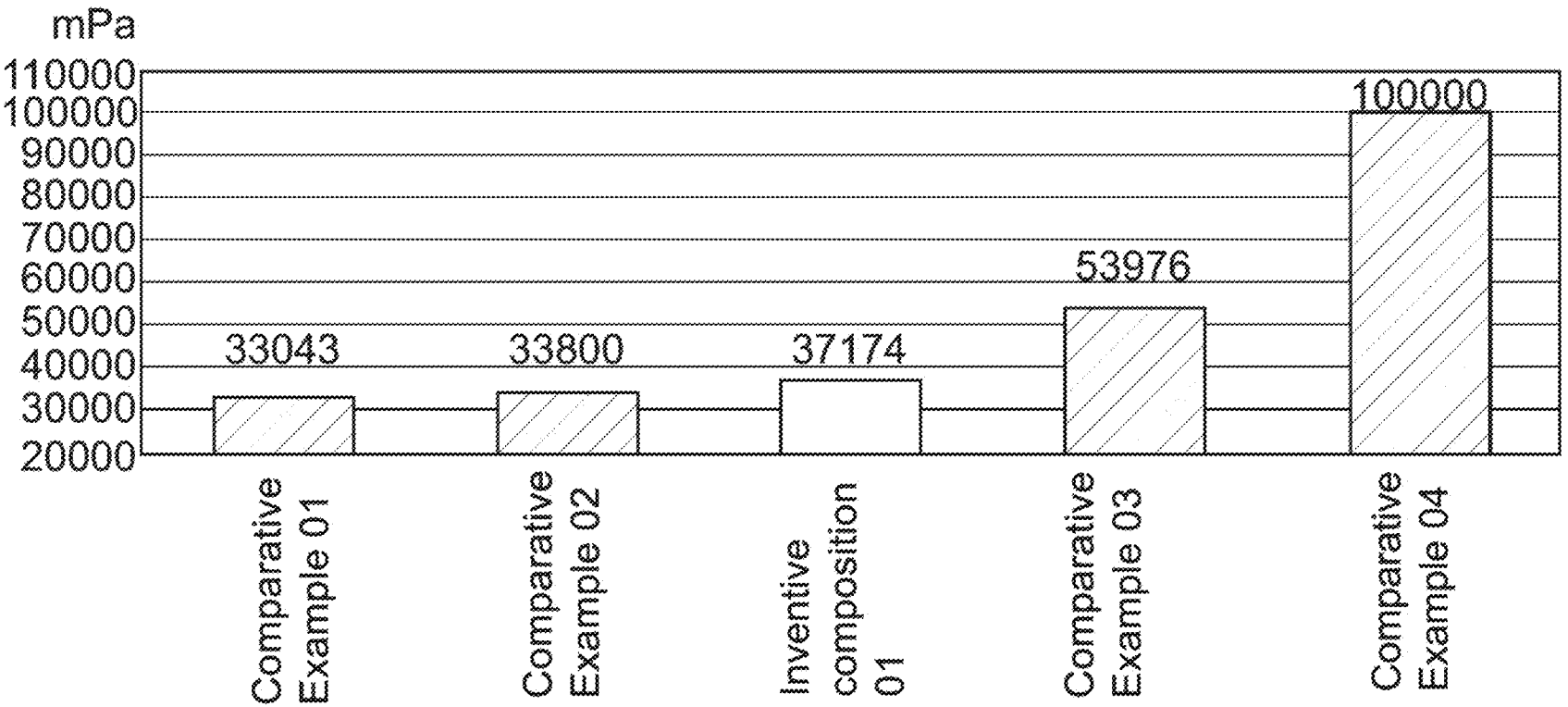
FIG. 4: Apparent dynamic viscosity of various lubricant compositions.

The results are illustrated in the following Table 2 and in FIGS. 3 (evaporation behavior) and 4 (apparent dynamic viscosity).

TABLE 2

| Closed dish tests | | Comparative Example 01 | Comparative Example 02 | Inventive composition 01 | Comparative Example 03 | Comparative Example 04 |
|---|---|---|---|---|---|---|
| 72 h/230° C. | Weight % | 61.8 | 57.8 | 59.5 | 59.8 | 61.4 |
| 72 h/230° C. | mPas | 33043 | 33800 | 37174 | 53976 | >100000 |

It is found that hydroxytyrosol has no noticeable influence on the evaporation behavior. Furthermore, it is found that hydroxytyrosol, as a phenolic antioxidant, exhibits a performance with regard to the suppression of free-radical aging processes comparable to that of amines estimated to be more efficient in the prior art and has a significantly better effect than other phenols.

Figure 5:
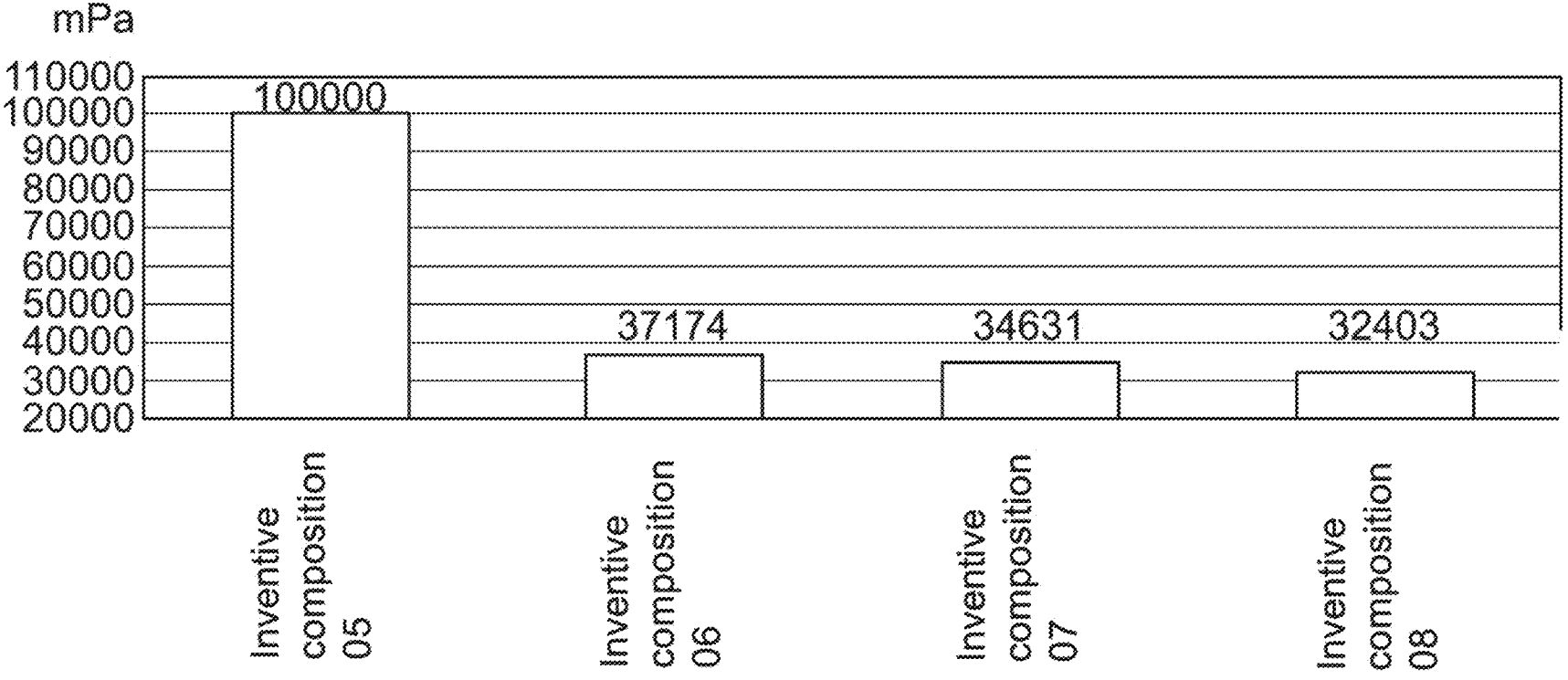
FIG. 5: Apparent dynamic viscosity of various lubricant compositions.

2.2 In order to be able to determine the influence of the concentration of hydroxytyrosol, inventive compositions 5, 6, 7 and 8 were additionally investigated comparatively. The results are illustrated in the following Table 3 and in FIG. 5 (apparent dynamic viscosity).

TABLE 3

| Closed dish tests | | Inventive composition 05 | Inventive composition 06 | Inventive composition 07 | Inventive composition 08 |
|---|---|---|---|---|---|
| 72 h/230° C. | Weight % | 62.3 | 59.5 | 60.5 | 60.4 |
| 72 h/230° C. | mPas | >100000 | 37174 | 34631 | 32403 |

It is found that hydroxytyrosol is highly efficient even at a very low concentration.

Example 3: Determination of the Onset of Oxidation and of the Threshold of the Course of Oxidation of Selected Compositions from Example 1

The onset of oxidation and the threshold of the course of oxidation of selected compositions from Example 1 is determined by means of dynamic DSC (heating rate 1° C./min). In the DSC measurement, the reaction kinetics are monitored comparatively within a base oil. The chemical dynamics within a substance system become visible, from which in turn the oxidation behavior with respect to the thermal energy input is inferred.

Figure 6:
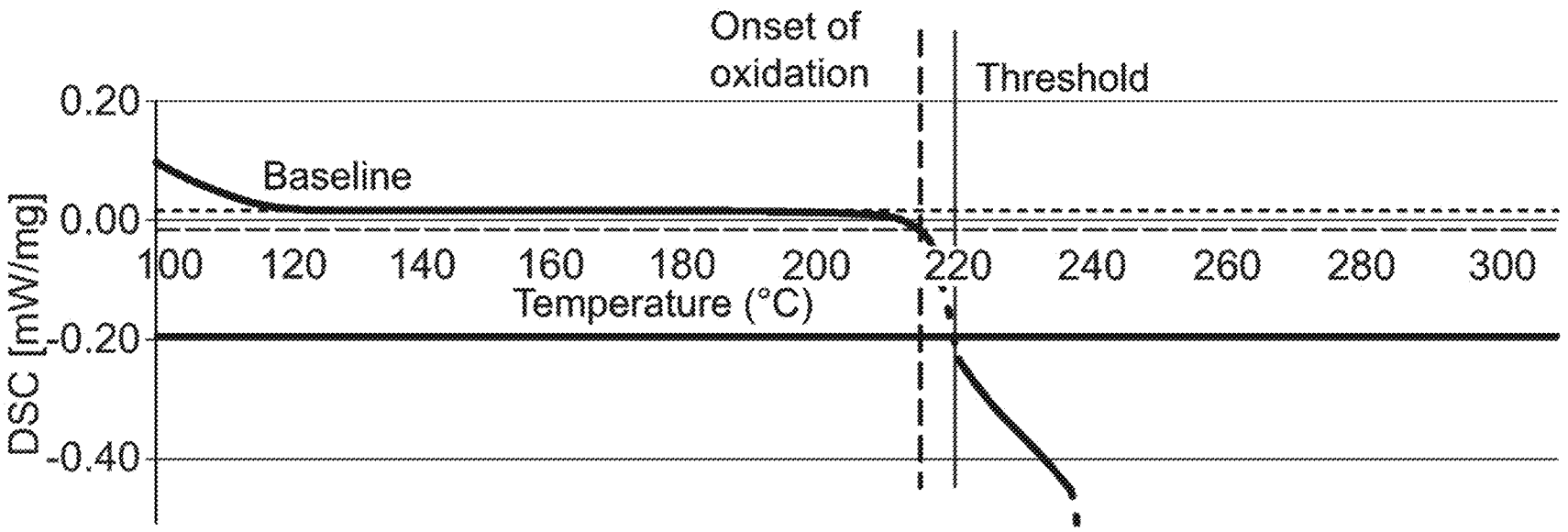
FIG. 6: Illustration of the measurement of oxidation commencement and threshold.

The value "onset of oxidation" describes a first significant potential change in relation to the thermal energy input and thus refers to the delay which a substance mixture experiences in comparison with another substance mixture. The threshold describes the progress of the aging/oxidation process within the substance mixture. This indirectly refers to the reaction rate of the oxidation process. This correlation is shown in FIG. 6.

The results shown in Tables 4-8 below and the corresponding figures were obtained.

TABLE 4

Figure 7:
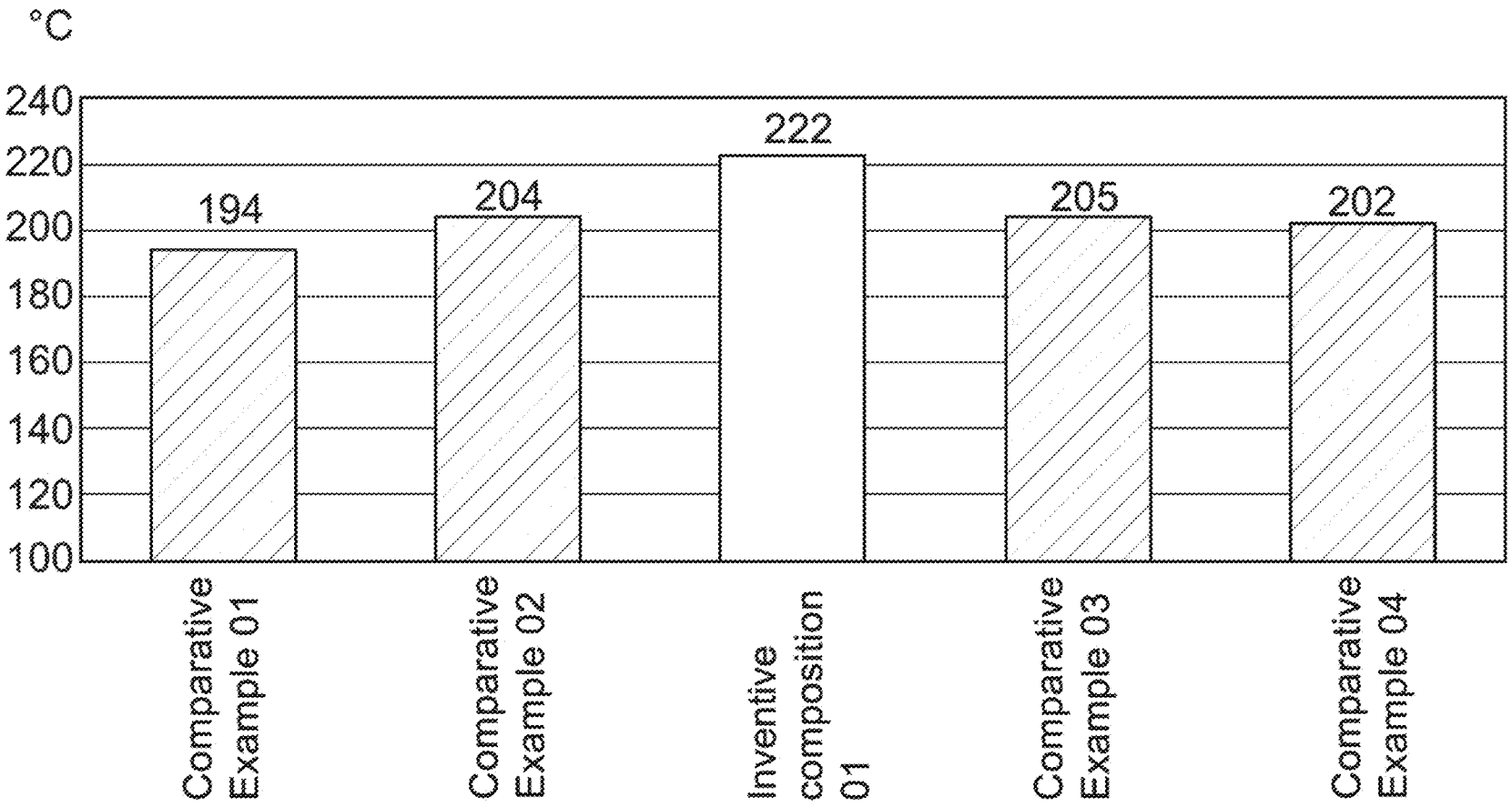
FIG. 7: Onset of oxidation of selected compositions.
Figure 8:
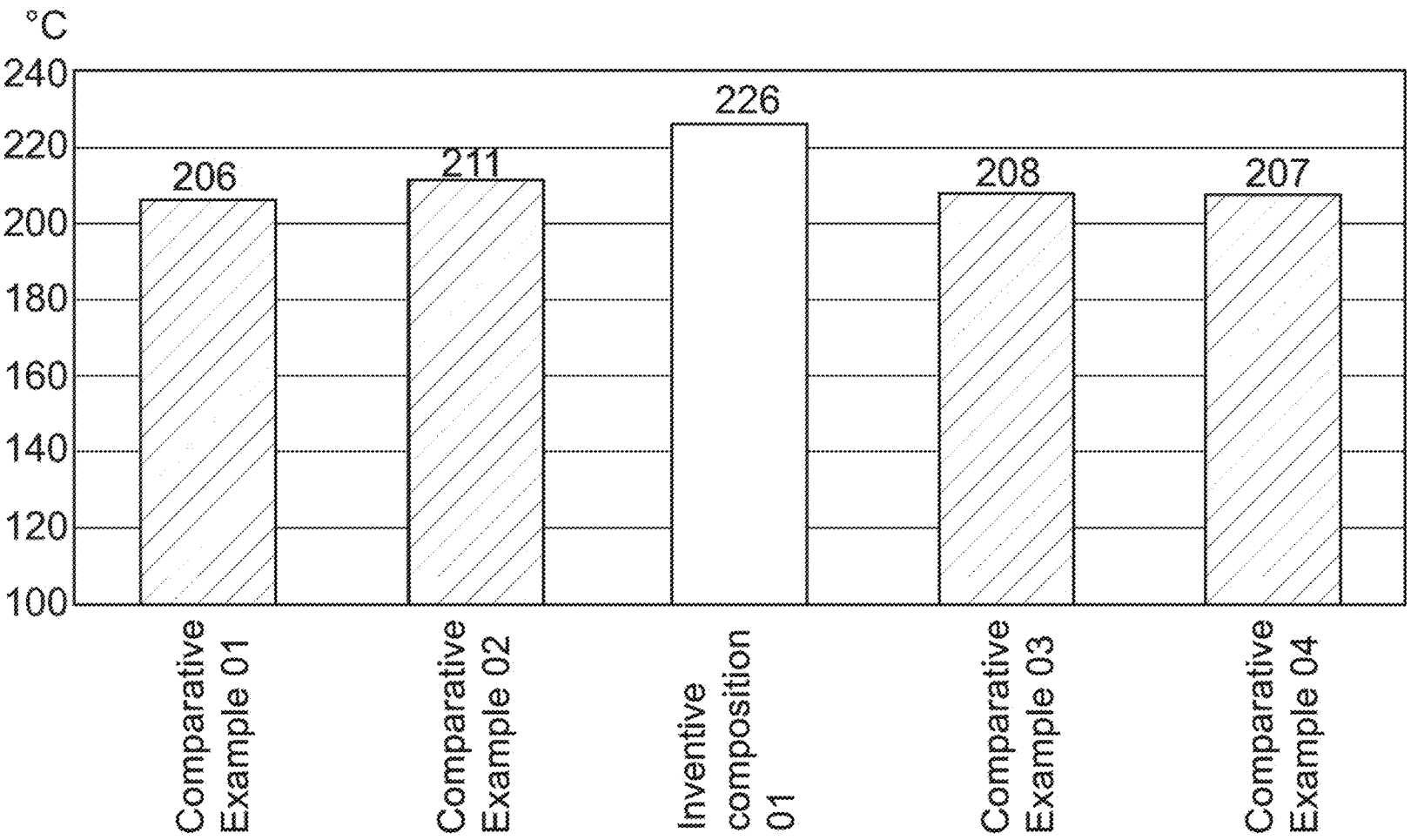
FIG. 8: Threshold of the course of oxidation of selected compositions.

(see FIG. 7: onset of oxidation, FIG. 8: threshold)

| DSC dyn. [heating rate 1° C./min] | | Comparative Example 01 | Comparative Example 02 | Inventive composition 01 | Comparative Example 03 | Comparative Example 04 |
|---|---|---|---|---|---|---|
| Onset of oxidation (x0) | ° C. | 194 | 204 | 222 | 205 | 202 |
| Threshold | ° C. | 206 | 211 | 226 | 208 | 207 |

It is found that the inventive composition 1 has a higher oxidation resistance than the comparative examples.

TABLE 5

Figure 9:
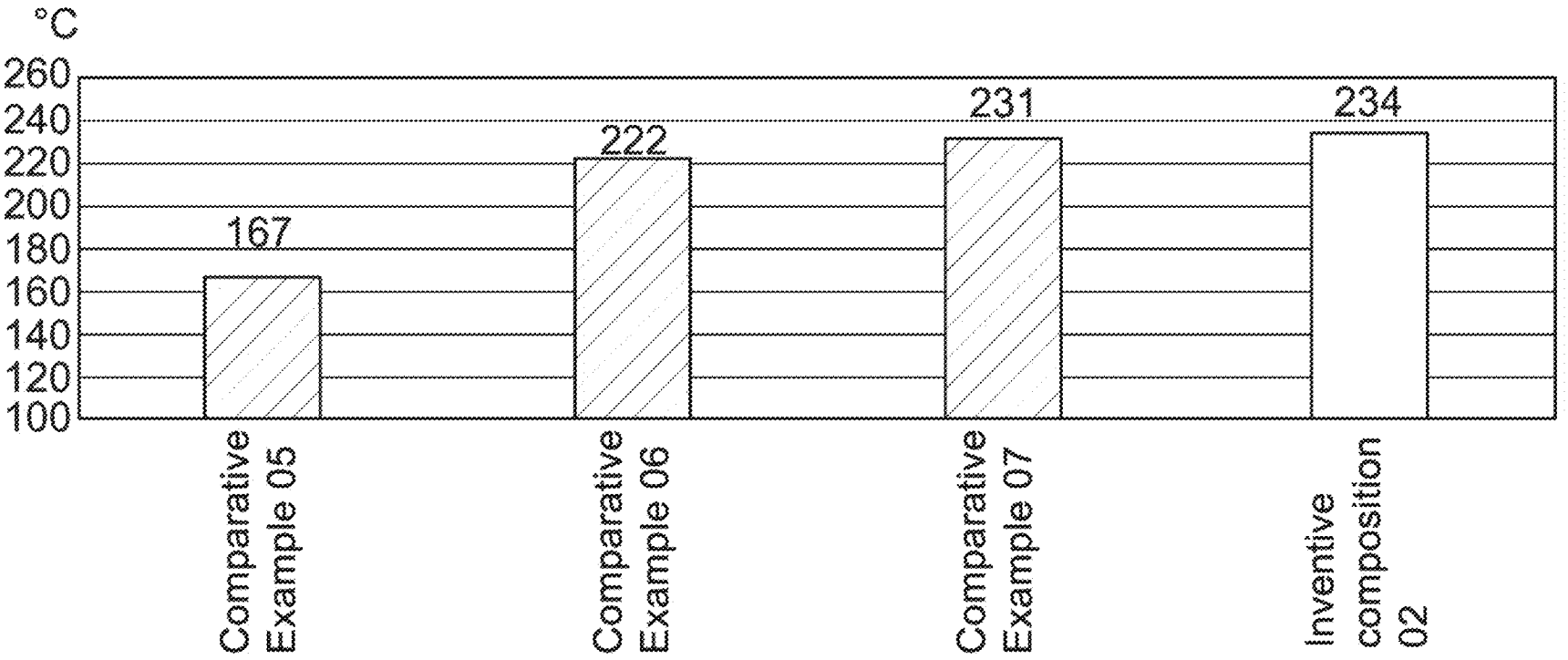
FIG. 9: Onset of oxidation of selected compositions.
Figure 10:
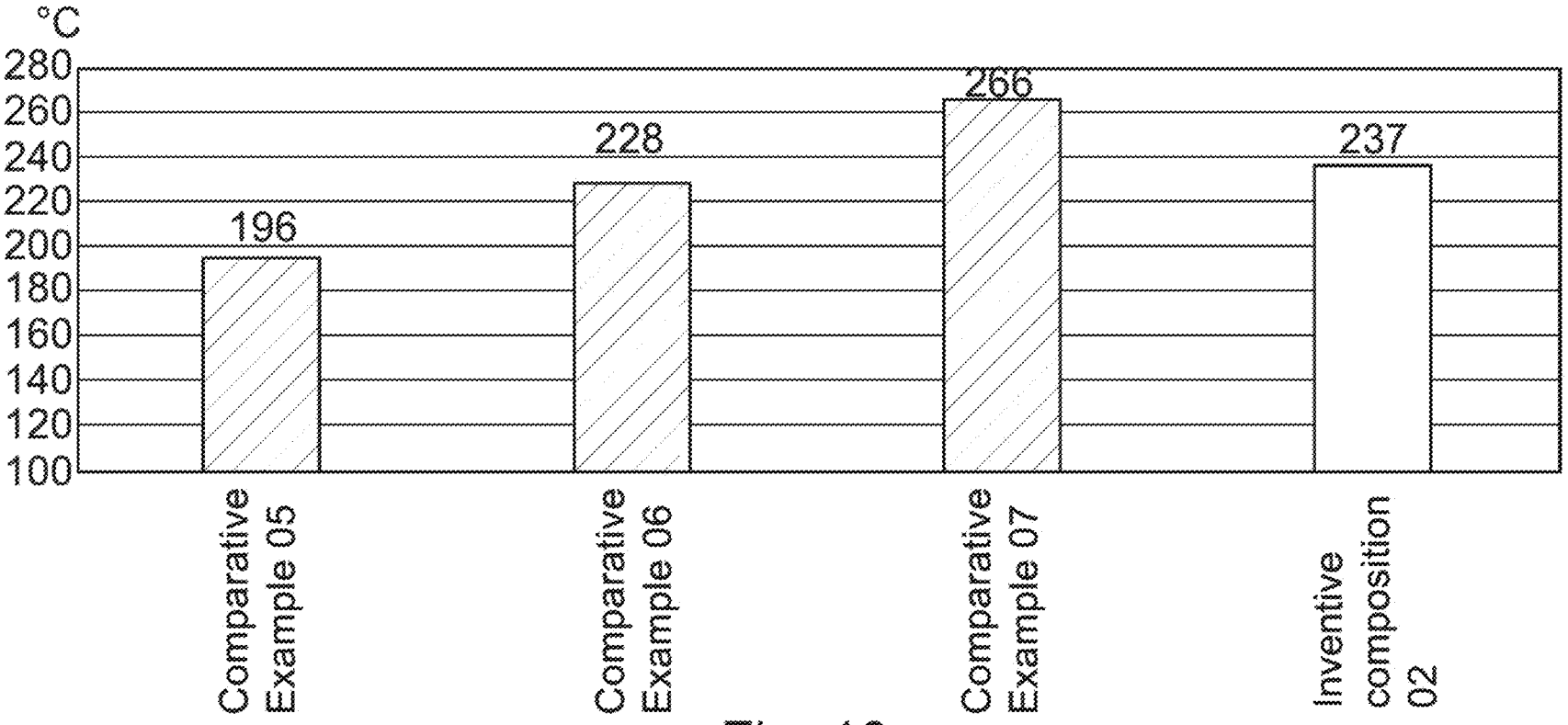
FIG. 10: Threshold of the course of oxidation of selected compositions.

(see FIG. 9: onset of oxidation, FIG. 10: threshold)

| DSC dyn. [heating rate 1° C./min] | | Comparative Example 05 | Comparative Example 06 | Comparative Example 07 | Inventive composition 02 |
|---|---|---|---|---|---|
| Onset of oxidation (x0) | ° C. | 167 | 222 | 231 | 234 |
| Threshold | ° C. | 196 | 228 | 266 | 237 |

It is found that the inventive composition 2 has a higher oxidation resistance than the pure base oil (Comparative Example 5) and than the Comparative Example 6 provided with the same amount of antioxidant. Moreover, the onset of oxidation determined for the inventive composition is above, and the threshold is only slightly below, the threshold of Comparative Example 7-although it has more than ten times the amount of antioxidant.

TABLE 6

Figure 11:
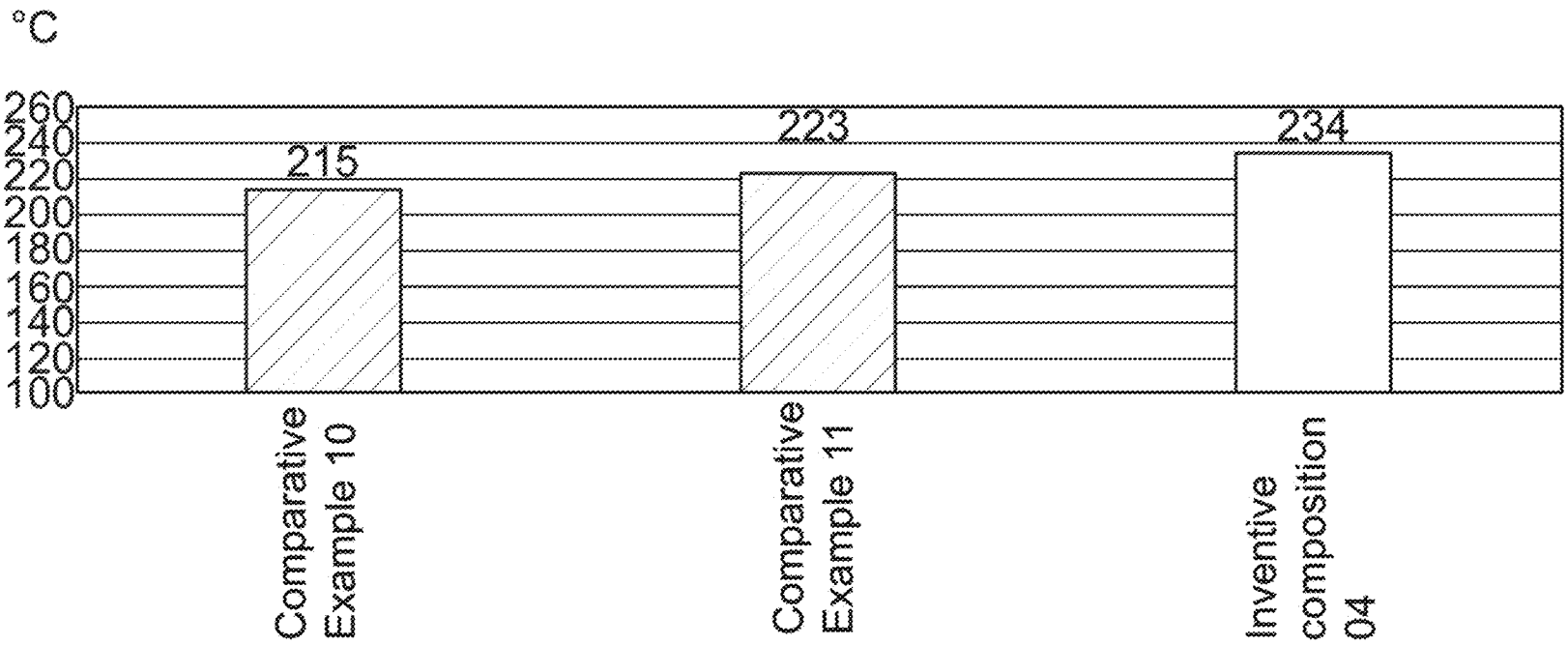
FIG. 11: Onset of oxidation of selected compositions.
Figure 12:
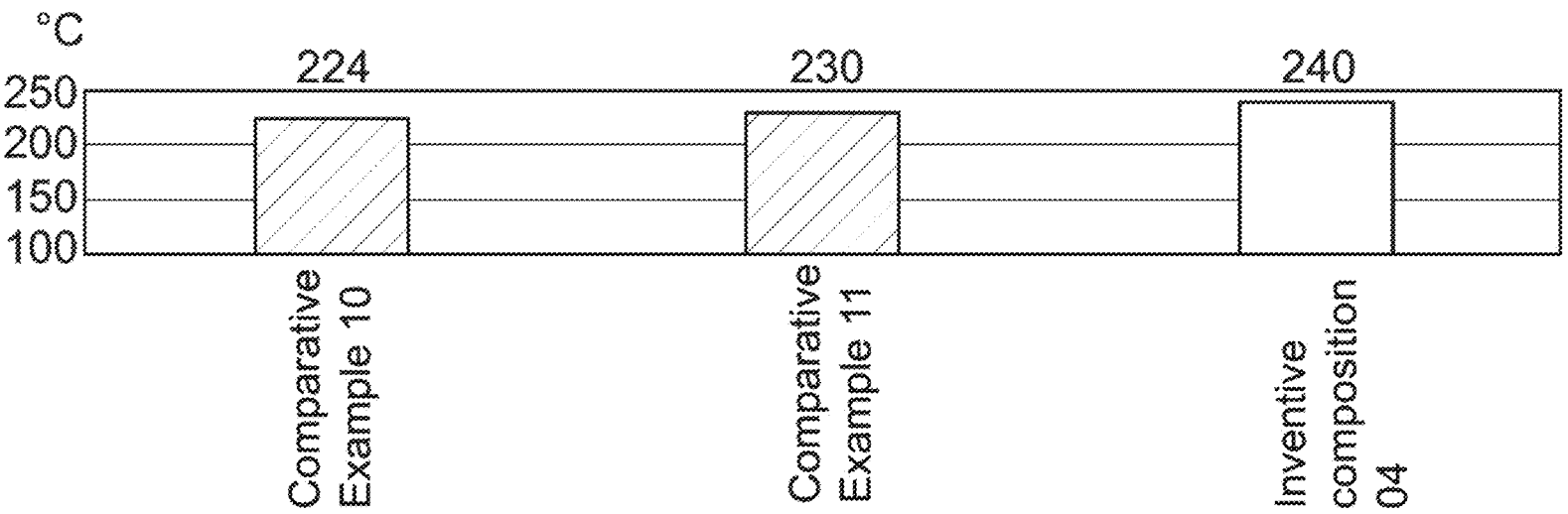
FIG. 12: Threshold of the course of oxidation of selected compositions.

(see FIG. 11: onset of oxidation, FIG. 12: threshold)

| DSC dyn. [heating rate 1° C./min] | | Comparative Example 10 | Comparative Example 11 | Inventive composition 04 |
|---|---|---|---|---|
| Onset of oxidation (x0) | ° C. | 215 | 223 | 234 |
| Threshold | ° C. | 224 | 230 | 240 |

It is found that the inventive composition 4 has a higher oxidation resistance than the comparative examples.

TABLE 7

Figure 13:
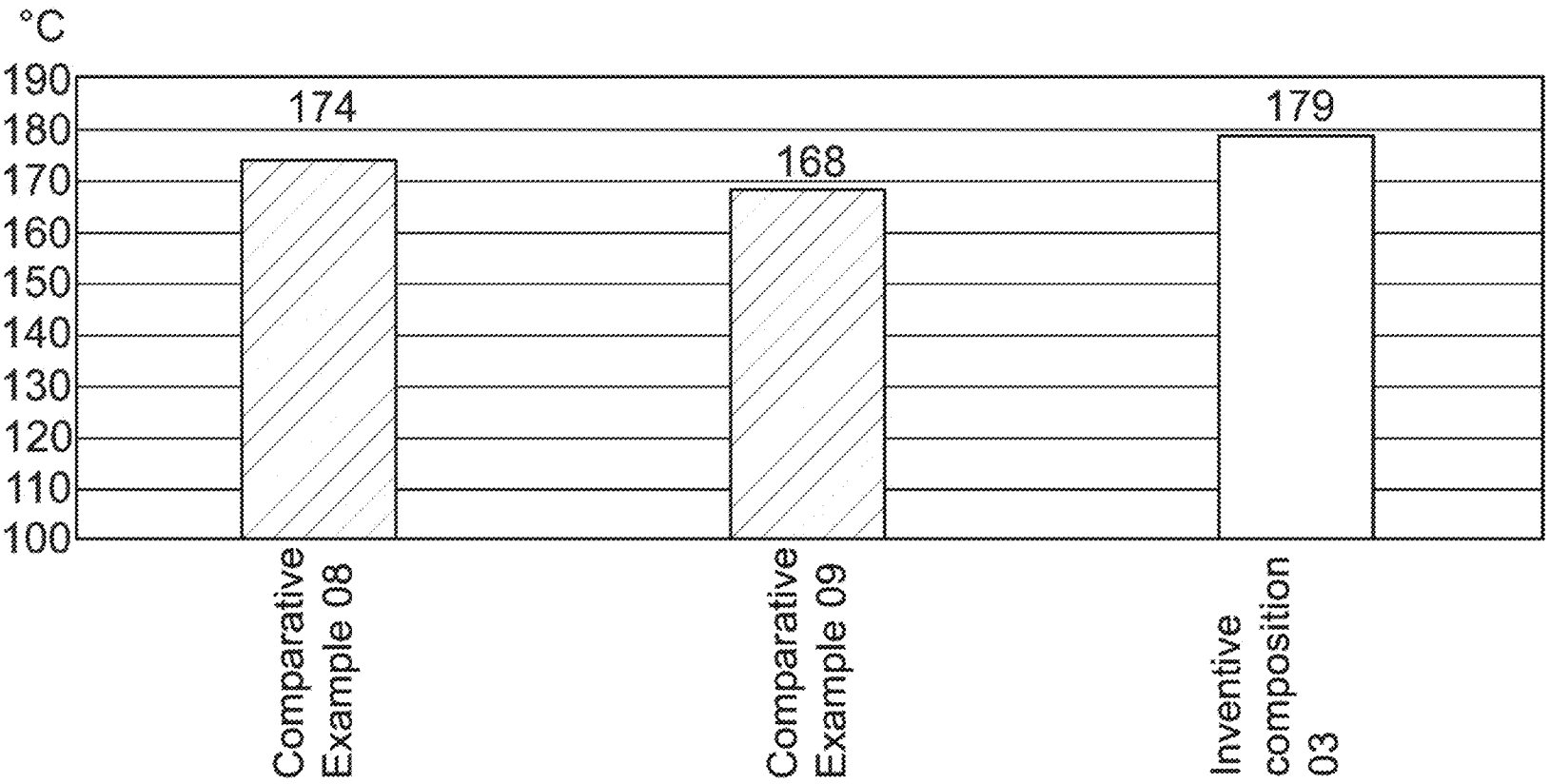
FIG. 13: Onset of oxidation of selected compositions.
Figure 14:
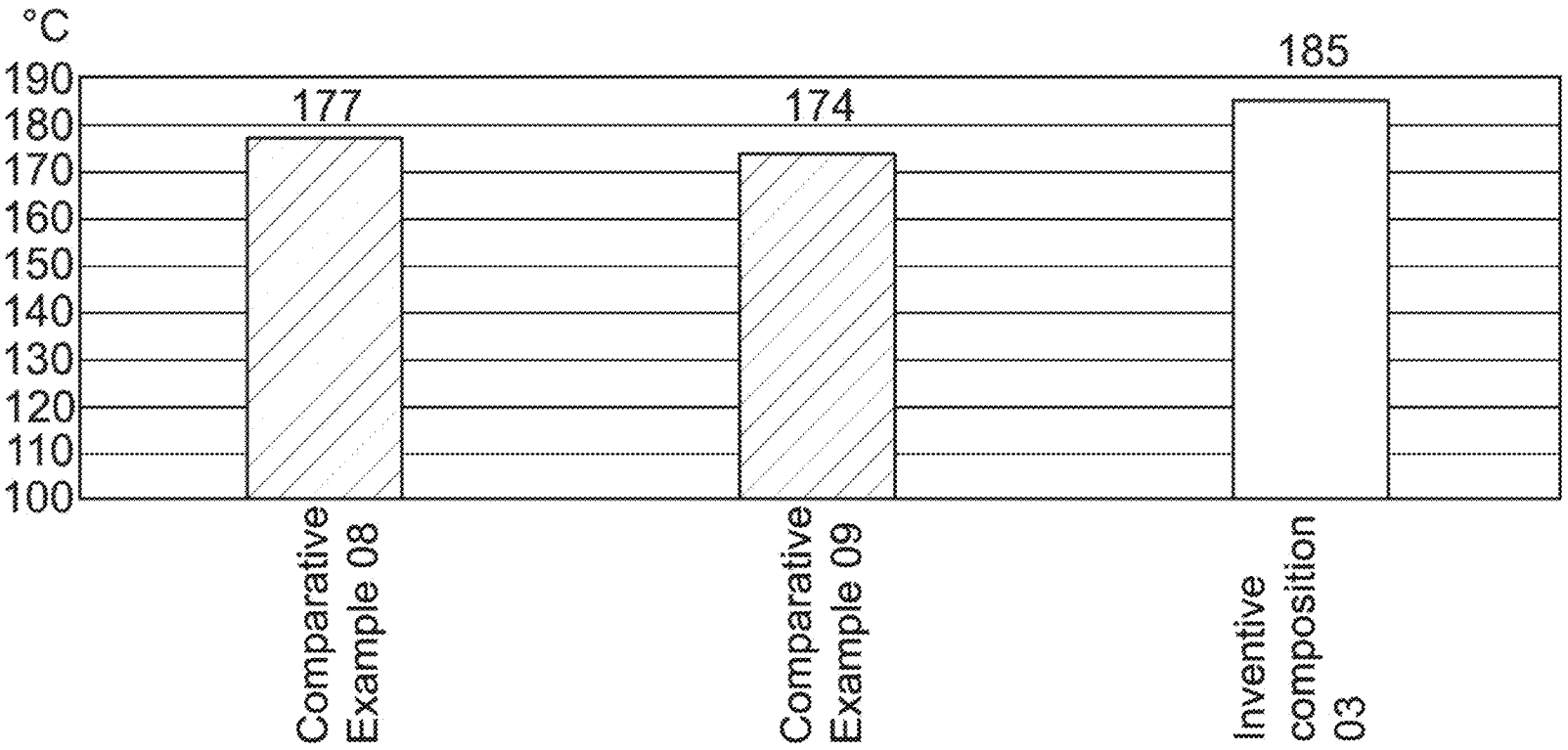
FIG. 14: Threshold of the course of oxidation of selected compositions.

(see FIG. 13: onset of oxidation, FIG. 14: threshold)

| DSC dyn. [heating rate 1° C./min] | | Comparative Example 08 | Comparative Example 09 | Inventive composition 03 |
|---|---|---|---|---|
| Onset of oxidation (x0) | ° C. | 174 | 168 | 179 |
| Threshold | ° C. | 177 | 174 | 185 |

It is found that the inventive composition 3 has a higher oxidation resistance than the comparative examples.

TABLE 8

Figure 15:
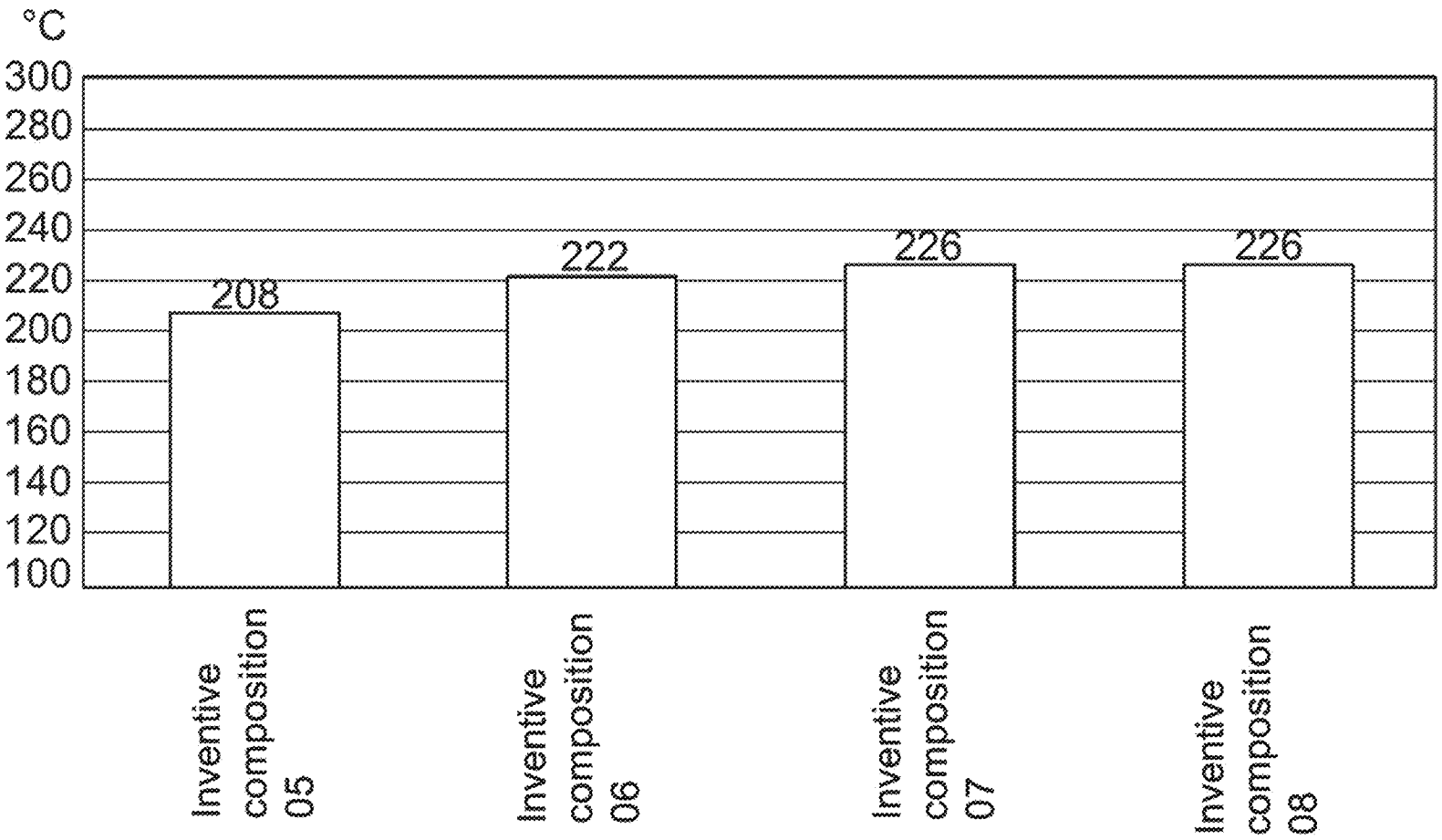
FIG. 15: Onset of oxidation of selected compositions.
Figure 16:
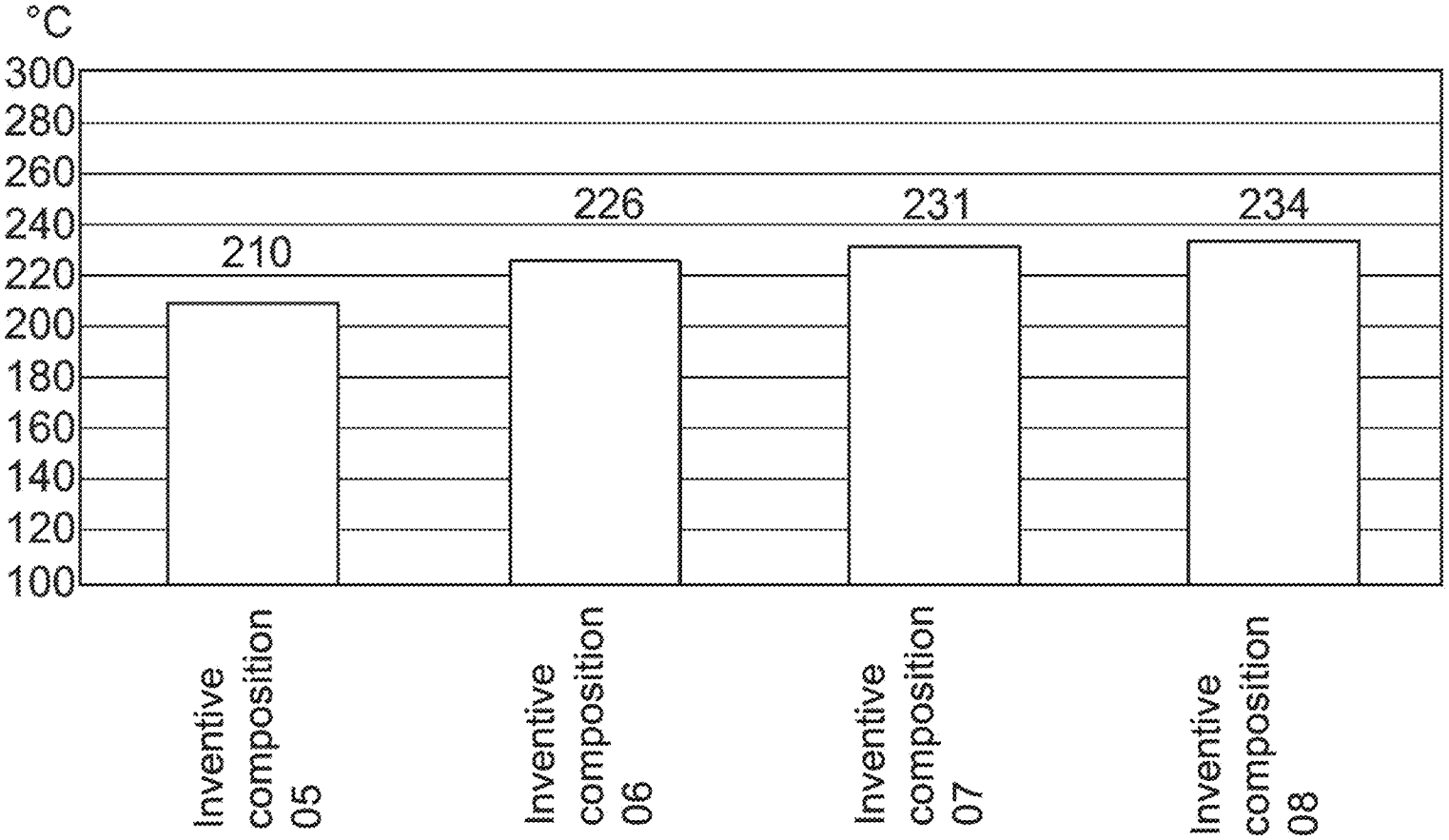
FIG. 16: Threshold of the course of oxidation of selected compositions.

(see FIG. 15: onset of oxidation, FIG. 16: threshold)

| DSC dyn. [heating rate 1° C./min] | | Inventive composition 05 | Inventive composition 06 | Inventive composition 07 | Inventive composition 08 |
|---|---|---|---|---|---|
| Onset of oxidation (x0) | ° C. | 208 | 222 | 226 | 226 |
| Threshold | ° C. | 210 | 226 | 231 | 234 |

It is found that hydroxytyrosol has a high antioxidant effect even at very low concentrations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A lubricant composition comprising:

a base oil and hydroxytyrosol and/or esters thereof, wherein the base oil comprises an ester of an aromatic or aliphatic dicarboxylic, tricarboxylic or tetracarboxylic acid having one or a mixture of $C_7$ to $C_{22}$ alcohols, a polyphenyl ether or alkylated diphenyl ether, an ester of trimethylolpropane, pentaerythritol or dipentaerythritol with aliphatic $C_7$ to $C_{22}$ carboxylic acids, Cm dimer acid esters manufactured from $C_7$ to $C_{22}$ alcohols, complex esters, or any mixture thereof.

2. The lubricant composition according to claim 1, wherein the esters have a solubility in the base oil at 25° C. of at least 0.1 g/l.

3. The lubricant composition according to claim 1, wherein the esters are at least partly carboxylic acid esters comprising esters of hydroxytyrosol and $C_{2-10}$ carboxylic acids.

4. The lubricant composition according to claim 1, wherein the esters are at least partly esters of hydroxytyrosol and citric acid.

5. The lubricant composition according to claim 1, wherein the hydroxytyrosol is solubilized hydroxytyrosol.

6. The lubricant composition according to claim 5, wherein a solubility of the hydroxytyrosol is increased by adding $C_{2-10}$ carboxylic acids as a solubilizing agent.

7. The lubricant composition according to claim 1, wherein a proportion of hydroxytyrosol and/or of its esters is from 0.01% by weight to 2% by weight, based on a total weight of the lubricant composition.

8. The lubricant composition according to claim 1, wherein the base oil further comprises esters, polyglycols, naphthenic and/or aromatic mineral oils, synthetic hydrocarbons, phenyl ethers, polyalphaolefins, native base oils and derivatives of native oils, or any mixture thereof.

9. The lubricant composition according to claim 1, wherein the base oil has a viscosity, measured at 40° C., in a range of 10 $mm^2/s$ to 1000 $mm^2/s$.

10. A method for producing a lubricant composition, comprising:

providing a base oil, and mixing the base oil with hydroxytyrosol and/or its esters so as to obtain the lubricant composition, wherein the base oil comprises an ester of an aromatic or aliphatic dicarboxylic, tricarboxylic or tetracarboxylic acid having one or a mixture of $C_7$ to $C_{22}$ alcohols, a polyphenyl ether or alkylated diphenyl ether, an ester of trimethylolpropane, pentaerythritol or dipentaerythritol with aliphatic $C_7$ to $C_{22}$ carboxylic acids, Cm dimer acid esters manufactured from $C_7$ to $C_{22}$ alcohols, complex esters, or any mixture thereof.

11. The method according to claim 10, wherein the mixing of the base oil with hydroxytyrosol and/or its esters takes place in the presence of a solubilizing agent.

12. A method comprising:

lubricating the surfaces of sliding partners in a tribological system with a lubricant composition according to claim 1.

13. The method of claim 12, wherein the tribological system comprises H1 high-temperature applications for lifetime and/or consumption lubrication in components comprising chains, transmissions, bearings, fittings and/or marine components.

14. The method according to claim 2, wherein the esters have a solubility in the base oil at 25° C. of 0.1 to 5.0 g/l.

15. The method according to claim 3, wherein the carboxylic acid esters are present in branched and/or unbranched form.

16. The method according to claim 3, wherein the carboxylic acid esters have one or more substituents comprising hydroxyl groups and/or one or more carboxylic acid groups.

17. The method of claim 6, wherein the $C_{2-10}$ carboxylic acids are present in branched and/or unbranched form.

18. The method of claim 6, wherein the $C_{2-10}$ carboxylic acids have one or more substituents comprising hydroxyl groups and/or one or more carboxylic acid groups.

19. The method according to claim 10, wherein the base oil further comprises esters, polyglycols, naphthenic and/or aromatic mineral oils, synthetic hydrocarbons, phenyl ethers, polyalphaolefins, native base oils and derivatives of native oils, or any mixture thereof.

* * * * *